US007740144B2

(12) United States Patent
Kosir

(10) Patent No.: US 7,740,144 B2
(45) Date of Patent: Jun. 22, 2010

(54) UNDER SHELF MOUNT

(75) Inventor: Joseph P. Kosir, Euclid, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 669 days.

(21) Appl. No.: 11/333,494

(22) Filed: Jan. 17, 2006

(65) Prior Publication Data

US 2007/0163971 A1 Jul. 19, 2007

(51) Int. Cl.
*A47G 29/087* (2006.01)

(52) U.S. Cl. ..... 211/119.003; 211/57.1; 211/59.1; 211/113

(58) Field of Classification Search ..... 211/187, 211/119.003, 59.1, 88.01, 90.01, 90.03, 57.1; 248/235, 250, 220.42, 220.41, 220.31, 222.11, 248/220.22, 223.41, 231.21, 307; 40/661.11, 40/661.08, 661.03, 606.01, 611.12, 658; 312/140.4, 234.1, 234.4, 234.5; D8/381
See application file for complete search history.

(56) References Cited

U.S. PATENT DOCUMENTS 2,787,433 A * 4/1957 Slavsky et. al. ..... 248/231.71
3,015,177 A * 1/1962 Hembd et al. ..... 40/665
3,214,122 A * 10/1965 Frederickson ..... 248/220.22
3,250,235 A * 5/1966 McDonnell ..... 108/152
3,530,605 A * 9/1970 Gutterson ..... 40/658
3,711,973 A * 1/1973 Slavsky ..... 40/658
3,728,806 A * 4/1973 Kostiuk ..... 40/658
3,797,143 A * 3/1974 Miller ..... 40/658
3,815,756 A * 6/1974 Cox ..... 211/57.1
3,853,293 A * 12/1974 Larson ..... 248/220.42
3,985,324 A * 10/1976 Larson ..... 248/220.42
4,303,217 A 12/1981 Garfinkle
4,452,360 A 6/1984 Barnes
4,558,838 A * 12/1985 Klein ..... 248/235
4,706,917 A * 11/1987 Thalenfeld ..... 248/205.1
4,783,033 A 11/1988 Valiulis
4,805,331 A 2/1989 Boggess et al.
4,871,135 A * 10/1989 Thalenfeld ..... 248/220.22
4,881,707 A 11/1989 Garfinkle
4,905,846 A 3/1990 Calvert
4,909,464 A 3/1990 Levine et al.
4,995,182 A 2/1991 Fast
5,060,897 A 10/1991 Thalenfeld
5,233,773 A 8/1993 Reynolds
5,339,967 A * 8/1994 Valiulis ..... 211/57.1
5,346,166 A * 9/1994 Valiulis ..... 248/220.41
5,657,884 A 8/1997 Zilincar, III
5,678,699 A * 10/1997 Gebka ..... 211/57.1

(Continued)

OTHER PUBLICATIONS

FFr Yellow Pages 2004 Product Catalog, 135-137, 139 and 140.

*Primary Examiner*—Darnell Jayne
*Assistant Examiner*—Stanton L Krycinski
(74) *Attorney, Agent, or Firm*—Fay Sharpe LLP

(57) ABSTRACT

The present invention generally relates to a display system for a display shelf having a top surface and a bottom surface. The display system includes an engagement member and a display member. The engagement member is located substantially beneath the display shelf and includes a resilient portion for releasably securing the display system to the display shelf. The display member is connected to and protrudes away from the engagement member.

22 Claims, 5 Drawing Sheets

U.S. PATENT DOCUMENTS 5,678,795 A * 10/1997 Henry et al. ..... 248/220.41
5,683,003 A 11/1997 Gebka
5,722,625 A * 3/1998 Kenney ..... 248/220.41
5,832,644 A 11/1998 Mason
5,918,842 A * 7/1999 Garfinkle ..... 248/223.41
5,924,367 A * 7/1999 Henke et al. ..... 108/108
6,012,244 A * 1/2000 Begum et al. ..... 40/661.03
6,082,687 A 7/2000 Kump et al.
6,189,248 B1 * 2/2001 Nagel et al. ..... 40/661.03
6,202,334 B1 3/2001 Reynolds et al.
6,289,618 B1 9/2001 Kump et al.
6,341,755 B1 * 1/2002 Kump ..... 248/220.41
D453,534 S * 2/2002 Kosir ..... D20/43
6,349,909 B1 * 2/2002 Zarrow et al. ..... 248/220.41
6,354,546 B1 3/2002 Mueller
D455,067 S * 4/2002 Shea ..... D8/373
D463,251 S * 9/2002 Shea ..... D8/354
D474,395 S 5/2003 Mueller
6,622,979 B2 * 9/2003 Valiulis ..... 248/220.42
6,651,369 B1 * 11/2003 Keating et al. ..... 40/658
D483,656 S * 12/2003 Shea ..... D8/381
6,698,124 B2 * 3/2004 Kump et al. ..... 40/642.02
D491,054 S 6/2004 Caterinacci, Jr.
D496,693 S 9/2004 Mueller
7,055,274 B2 * 6/2006 Fast et al. ..... 40/661.03
7,100,878 B2 * 9/2006 Shea ..... 248/220.31
7,322,138 B2 * 1/2008 Gormley et al. ..... 40/658
7,401,430 B2 * 7/2008 Lindquist et al. ..... 40/657
2001/0013567 A1 * 8/2001 Valiulis ..... 248/220.41
2002/0029505 A1 * 3/2002 Faneuf ..... 40/658
2003/0164432 A1 * 9/2003 Shea ..... 248/220.31
2005/0218280 A1 * 10/2005 Rojas ..... 248/220.31
2006/0011794 A1 * 1/2006 Zadak et al. ..... 248/220.31
2006/0261016 A1 * 11/2006 Magid ..... 211/57.1
2007/0044361 A1 * 3/2007 Gormley et al. ..... 40/661.03
2008/0141575 A1 * 6/2008 Keating ..... 40/661.11

* cited by examiner

UNDER SHELF MOUNT

BACKGROUND OF THE INVENTION

The present invention generally relates to a point of purchase display system for use with a display rack, shelf or other product carrying structures employed in retail stores for displaying merchandise. More particularly, it relates to a mount for attaching a display member beneath a display shelf.

Businesses use a wide variety of devices to display products and sale prices to consumers. Shelving structures and related display units for displaying merchandise are a common sight in any type of store or commercial establishment. The desire of any merchant is and always has been to draw a shopper's attention to the items the merchant is offering for sale. Small products, such as packages of snack foods, batteries, household items, and the like are commonly displayed forwardly of the front edge of a horizontally extending shelf, with the shelves themselves being used to support other products.

Often in displaying products on shelves, it is difficult to prominently display sale tags or price signs due to a lack of space at the front edge of a shelf or display rack. As a result, it is desirable to provide a holder which is mounted on a shelf or display rack for easy visibility of a sign and a product by a consumer and which allows the sign to be readily attached to or removed from the shelf or display rack.

Price tag and product display hangers and label holders used in merchandising displays have been common for some time. Typically, a device is attached by a laterally extending foot to a front portion or a top surface of a horizontal shelf to provide cantilever support for the hanger. A disadvantage of this device is that the mounting arrangement allows the front end of the device to be tipped up, making possible an inadvertent disengagement of the device from the shelf it is attached to. Another disadvantage of the device is that the mounting arrangement occupies a usable portion of the display shelf, thereby limiting the number of products which can be stacked on the shelf.

Accordingly, it has been considered desirable to develop a new and improved shelf mount which would overcome the foregoing difficulties and others while providing better and more advantageous overall results.

BRIEF DESCRIPTION OF THE INVENTION

In one embodiment of the present invention, a display system for a display shelf is provided.

More particularly, in accordance with this aspect of the present invention, a display system for a display shelf having a top surface and a bottom surface comprises an engagement member and a display member. The engagement member is located substantially beneath the display shelf and includes a resilient portion for releasably securing the display system to the display shelf. The display member is connected to and protrudes away from the engagement member.

In accordance with another aspect of the present invention, a display system comprises a mount including a base and a connector. The base has a top surface and a bottom surface, a first end and a second end. The connector is flexibly mounted to the base and extends approximately normal to the base for engaging a planar surface of a display shelf to releasably secure the base to the display shelf. A display member is connected to the base and extends away from the first end of the base.

In accordance with yet another aspect of the present invention, a mount is located substantially beneath a display shelf for attaching a display member to a bottom surface of the display shelf. The mount comprises a generally planar base and a pair of spaced connectors extending upwardly from the base. The connectors each include a finger for selectively engaging suitably shaped and positioned openings in the display shelf. The fingers are moveable relative to each other and are biased to return to their original configuration.

Still other aspects of the invention will become apparent from a reading and understanding of the detailed description of the several embodiments described hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the disclosure.

BRIEF DESCRIPTION OF THE INVENTION

It should, of course, be understood that the description and drawings herein are merely illustrative and that various modifications and changes can be made in the structures disclosed herein without departing form the spirit of the invention. Like numerals refer to like parts throughout the several views. It will also be appreciated that the various identified components of the shelf display disclosed herein are merely terms of art that may vary from one manufacturer to another and should not be deemed to limit the present invention.

Figure 1:
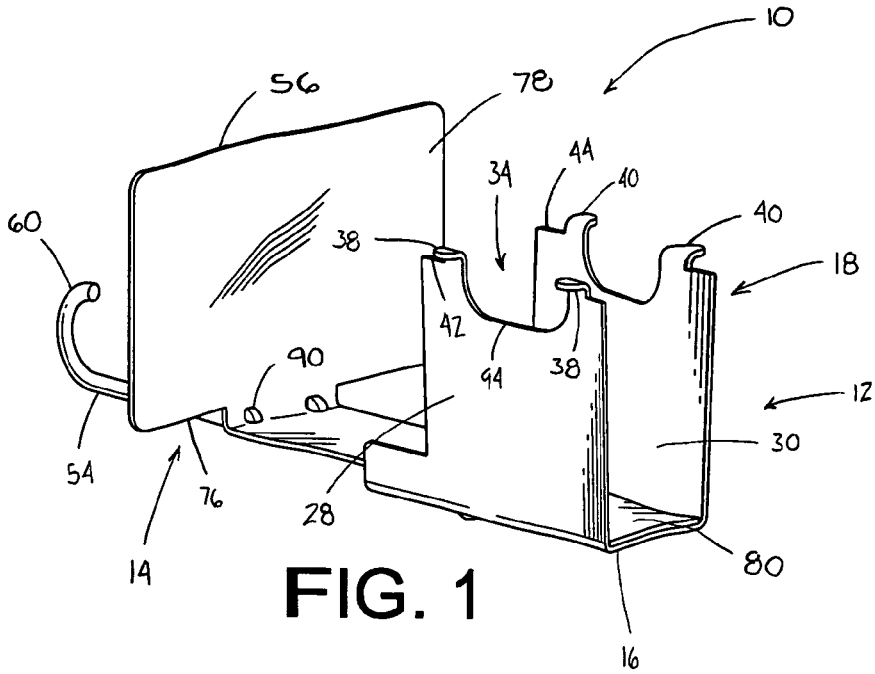
FIG. 1 is a rear perspective view illustrating a display system in accordance with a first embodiment of the present invention.
Figure 2:
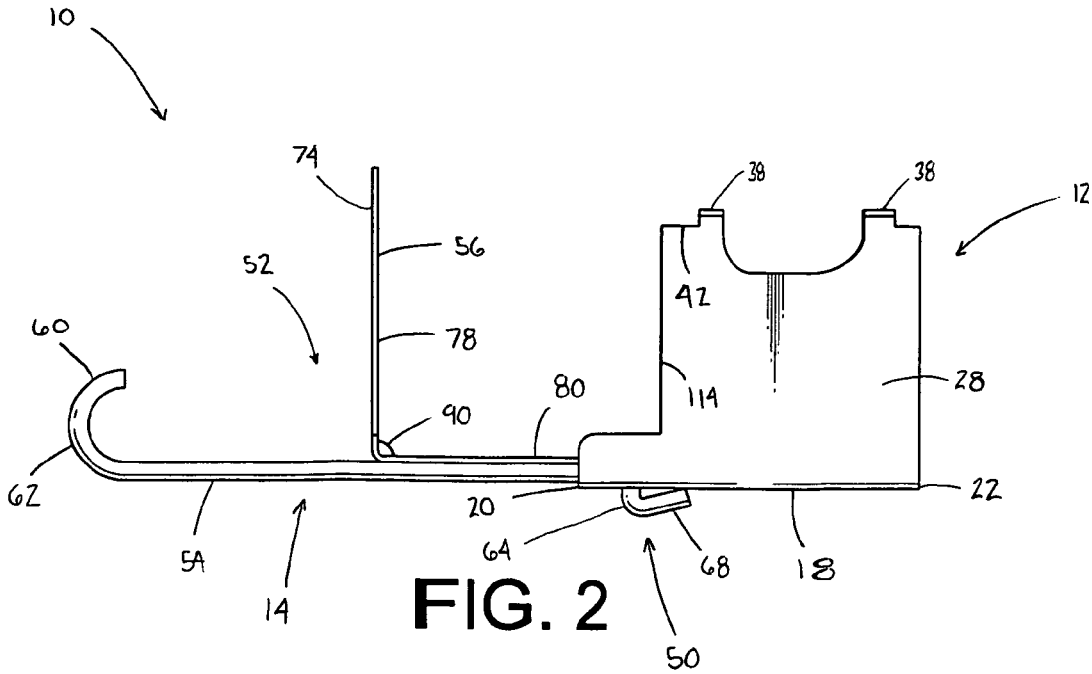
FIG. 2 is a right side elevational view of the display system of FIG. 1.
Figure 3:
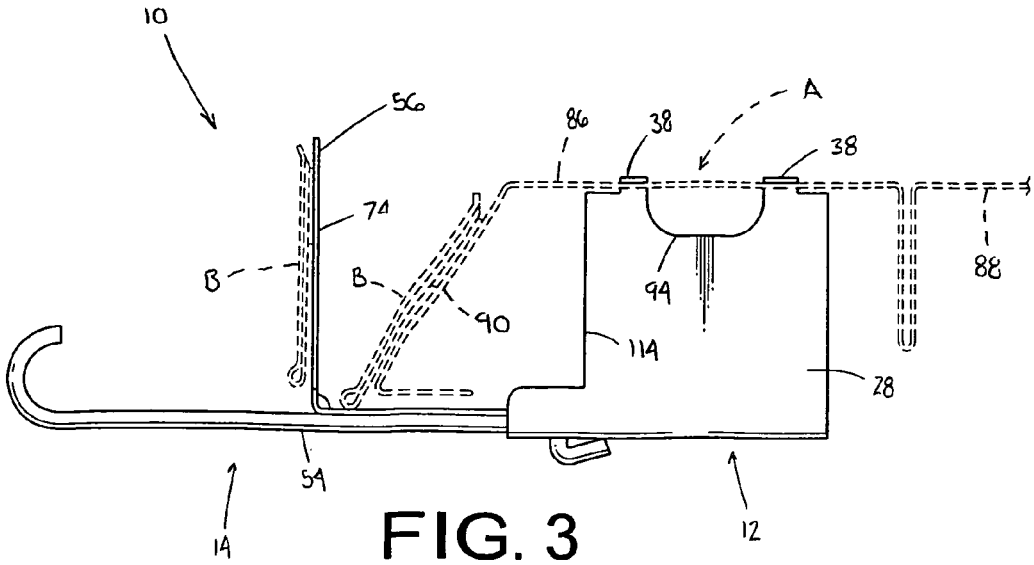
FIG. 3 is a right side elevational view of the display system of FIG. 1 mounted to a display shelf.

Referring now to the drawings, wherein the showings illustrate the embodiments of the invention only and are not intended to limit same, FIGS. 1-3 show a display system 10 for mounting to a support surface A in accordance with a first embodiment of the present invention. While the display system is primarily designed for, and will hereinafter be described in connection with a particular type of support surface, namely conventional apertured store type shelving of one particular design, it should be appreciated by those of average skill in the art that the display system could also be utilized with many other known types of store shelving. In addition, the disclosed display could be used in other types of display environments wherein other types of support surfaces are provided. These can include freezer cases, wire baskets, wire shelving, warehouse-type shelving and the like.

With reference to FIGS. 1 and 2, the display system 10 comprises an engagement member or mount 12 and a display member 14 connected to and protruding away from the mount. The mount generally includes a base 16 and resilient portion or connector 18 for releasably securing the display system to a horizontally extending support surface or display shelf A. The base is generally planar and has a top surface and a bottom surface, a first end 20 and a second end 22. The connector 18 is flexibly mounted to the base 16 and extends approximately normal to the base for engaging the display shelf.

The connector includes first and second opposed arms 28, 30, respectively, extending upwardly from the base 16. At least one of the first and second arms is deflectable towards the other of the first and second arms. The base 16 and the first and second arms 28, 30 define a generally U-shaped channel 34. The connector includes at least one finger extending away from the connector to releasably secure the mount to the display shelf A. In the disclosed embodiment, each arm 28, 30 has a pair of fingers 38, 40, which are preferably formed integrally with the arms. The fingers extend outwardly from a respective end 42, 44 of each arm. Of course, more or less than four fingers could be employed for attaching the mount to the shelf. As will be described in greater detail below, the fingers are dimensioned to selectively engage suitably shaped and positioned openings (not shown) in the display shelf.

The display member 14, which extends away from mount 12, includes a connecting portion 50 and a display portion 52 attached to the connecting portion. In the illustrated embodiment of FIGS. 1 and 2, the connecting portion is secured to the mount within the U-shaped channel 34. The display portion has elements which serve to display labels and to hang small items of merchandise. To this end, the display member includes a display arm 54 and a label holder 56. The display arm, which can define the shape of a hook, is configured for receiving packages of products to be displayed and may include an upwardly turned tip 60 at a forward, first end 62 of the display arm to inhibit packages from accidentally sliding off the arm. The packages could include holes in an upper portion thereof which are slid onto the display arm via the tip. A second end 64 of the display arm is attached to the base 16. The second end includes a generally L-shaped tip 68 which is dimensioned for receipt in an opening (not shown) located on the base.

The label holder 56 is configured for receiving display labels which provide pricing and other information about the product displayed on the display arm. Optionally, the label holder includes a flat, label plate 74 on which display labels may be adhesively fixed. A lower lip (not shown) can extends forwardly from a lower edge 76 of the plate as an additional support for a display label. Alternatively, the label holder includes other means of supporting a display label, such as upper and lower channels (not shown) which receive upper and lower edges of the display label or an adhesive surface for adhesively securing a label. The label holder further includes a leg 80 attached to the lower edge 76 and extending away from a rear surface 78 of the plate 74. The leg is dimensioned for receipt in the U-shaped channel 34 of the mount 12 and may be integrally formed with the display arm 54 or adhesively attached, welded or otherwise attached to a top surface of the base 16. The label plate 74 further includes at least one reinforcing member 90, in this embodiment in the form of a gusset. It provides the label holder 56 with additional stability against deflecting forces. In this embodiment, two such reinforcing members are provided. It should be appreciated that the reinforcing member could take other forms. For example, horizontal strengthening ribs can also extend along the rear surface 78 of the plate 74.

With reference to FIG. 3, the display system 10 is attached to a horizontal surface of the display shelf A so that the mount 12 is located substantially beneath the display shelf and the display member 14 protrudes in front of the shelf. In the depicted embodiment, the shelf is illustrated as being a conventional no tag shelf which includes a top surface 86, a bottom surface 88 and an upwardly and rearwardly sloping surface 90. If the display system does not include a label plate 74, there can be attached to the sloping surface a label holder B including a body panel and transparent cover member secured to each other at a hinge or pivot portion. The hinge is located along a bottom edge of each of the cover and body panel. To facilitate the insertion/removal of a label, the cover can be tipped forward. The resilient nature of the hinge will then bias the cover back to its closed position. The label holder B is generally conventional and understood by one skilled in the art so that further discussion herein is deemed unnecessary.

Because the mount 12 can be made from a suitable, somewhat resilient material, such as a conventional stamped metal piece, it is capable of quickly and effectively mounting the display system 10 beneath the display shelf A by inserting the fingers 38, 40 into the openings (not shown) in the display shelf. The respective ends 42, 44 of the first and second arms 28, 30 can be moved together such that the spacing between the opposed fingers is equal to the spacing between the shelf openings. Located between each pair of fingers is a generally C-shaped cutout 94 which can assist a user in moving the arms together. Once inserted into the opening, the arms can be released. The arms 28, 30 are biased to return to their original configuration, due to the natural resiliency of the mount material. Thus, upon release, the arms spring back to their original position thereby releasably locking the fingers in the shelf openings. As shown in FIG. 3, once the openings of the shelf are engaged by the pair of extending fingers 38, 40, the fingers lie generally flush against the top surface 86 of the display shelf. As such, the top surface is entirely usable for displaying product thereon. Once secured, base 16 is generally oriented parallel to the horizontally extending display shelf.

While the mount 12 has been discussed as comprising a metallic material, it should be appreciated that the mount could be made from any number of known thermoplastic or composite materials as well. Also, the display member 14 could be made from the same material as the mount 12, or from a different material, if so desired.

FIGS. 4-9 show various other embodiments of a display system according to the instant disclosure. Because the structure and function of the mount for each embodiment is substantially identical to that which was previously described, no further discussion relating to the structure and manner of usage and operation of the mount will be provided.

Figure 4:
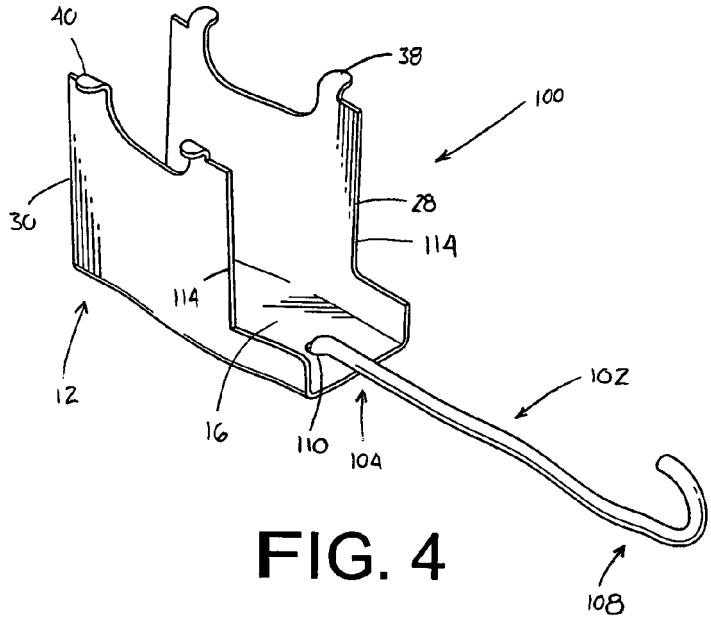
FIG. 4 is a front perspective view illustrating a display system in accordance with a second embodiment of the present invention.
Figure 5:
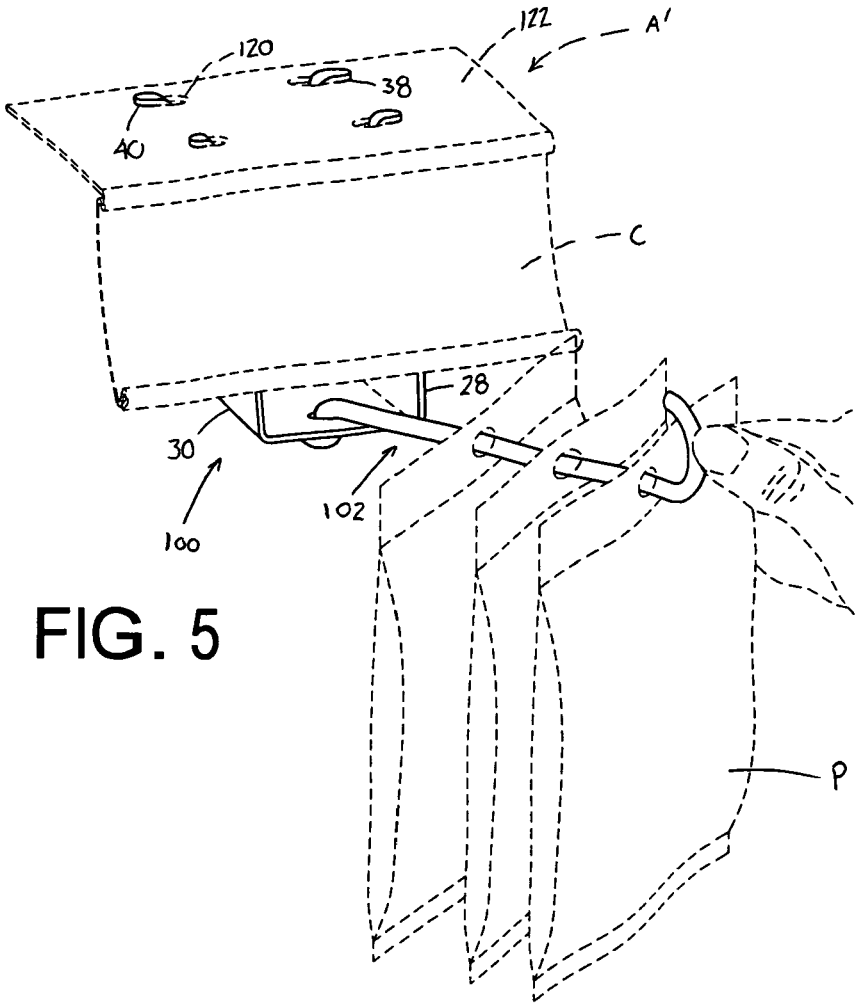
FIG. 5 is a front perspective view of the display system of FIG. 4 mounted to a display shelf.

With reference to FIGS. 4 and 5, a display system 100 includes the mount 12 and a display member 102. Similar to the first embodiment, the display member, which extends away from mount, includes a connecting portion 104 and a display portion 108 in the shape of a hook for receiving packages P of products. The connecting portion is attached to the base 16 through an opening 110 located on the base. As shown in FIG. 5, the mount 12 is releasably attached to another type of horizontally extending display shelf A'. The first and second arms 28, 30 suspend the display member 102 below a channel C located at a front edge of the display shelf. The mount 12, specifically the first and second arms, includes a generally L-shaped cutout 114 dimensioned to receive the channel. After securing the fingers 38, 40 in the openings 120 of the display shelf, the fingers are generally flush with a top surface 122 of the shelf. The display member 102 may be pivoted horizontally via the connecting portion 104, about a vertical axis of rotation, which extends through the base opening 110. During normal operation, therefore, when the display member 102 protrudes generally outward from the shelf A', the display member is pivotally coupled to the mount 12, and does not tend to be dislodged, for example, by accidental knocking of the display member or when packages P are removed from the display portion 108. At the same time, the display member 102 can rotate-out of the way when struck by a shopper traveling down a store aisle, thereby preventing injury to the shopper.

Figure 6:
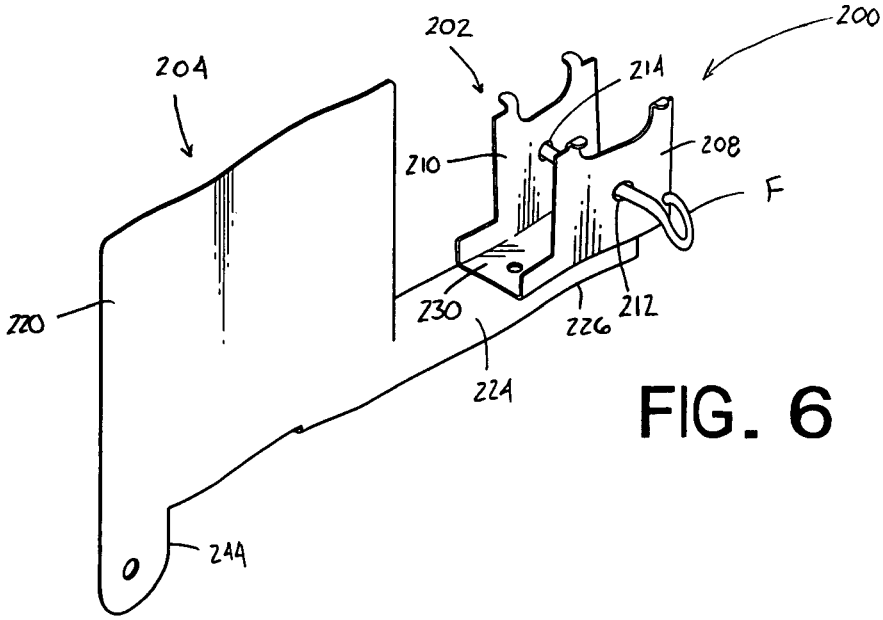
FIG. 6 is a front perspective view illustrating a display system in accordance with a third embodiment of the present invention.
Figure 7:
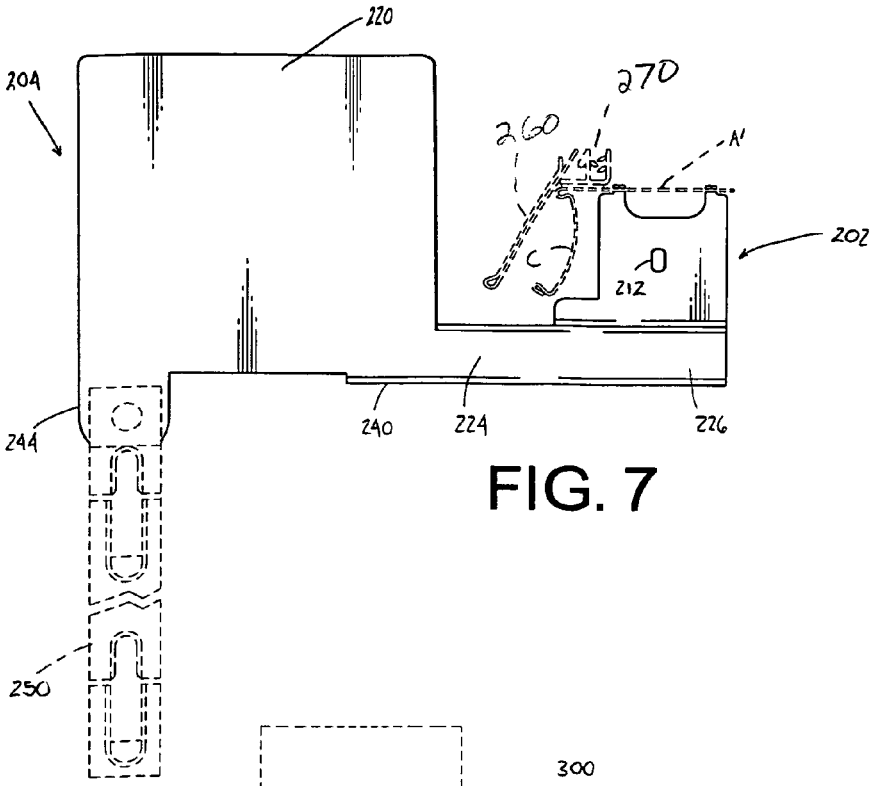
FIG. 7 is a right side elevational view of the display system of FIG. 6 mounted to a display shelf together with associated components thereof.

With reference now to FIGS. 6 and 7, a display system 200 includes a mount 202 and a display member 204. The mount includes first and second opposed arms 208, 210, respectively. Each arm can include an opening 212, 214. The openings are aligned and dimensioned to receive a conventional fastener F which can further secure the mount to a shelf bracket (not shown). The display member includes a side facing label holder 220 with left and right facing surfaces for displaying a label on each side of the label holder. A leg 224 is attached to and extends from the label holder. An end section 226 of the leg is attached to a base 230 of the mount 202. The leg can include strengthening members 240 which provides the label holder with additional stability against deflecting forces. The display member further includes a tab 244 have an aperture 246 for mounting a conventional elongated product holder 250.

In the embodiment of FIG. 7, a label holder 260 is mounted in front of a C-channel C of the shelf A'. Also, a second label holder 270 can be positioned at a front end of the shelf A'.

Figure 9:
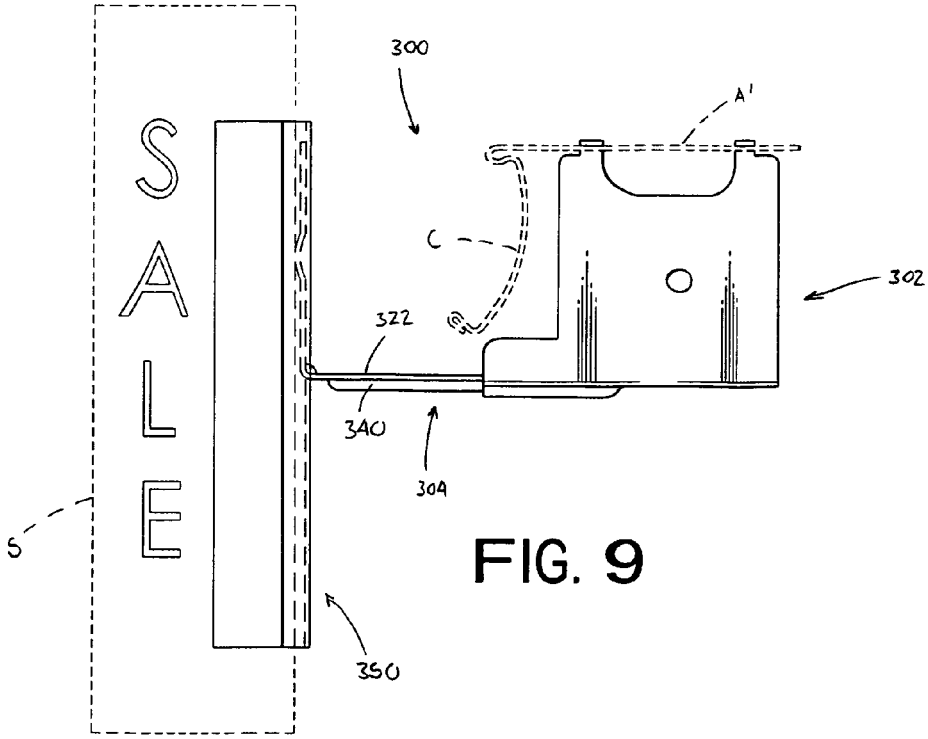
FIG. 9 is a right side elevational view of the display system of FIG. 8 mounted to a display shelf.
Figure 8:
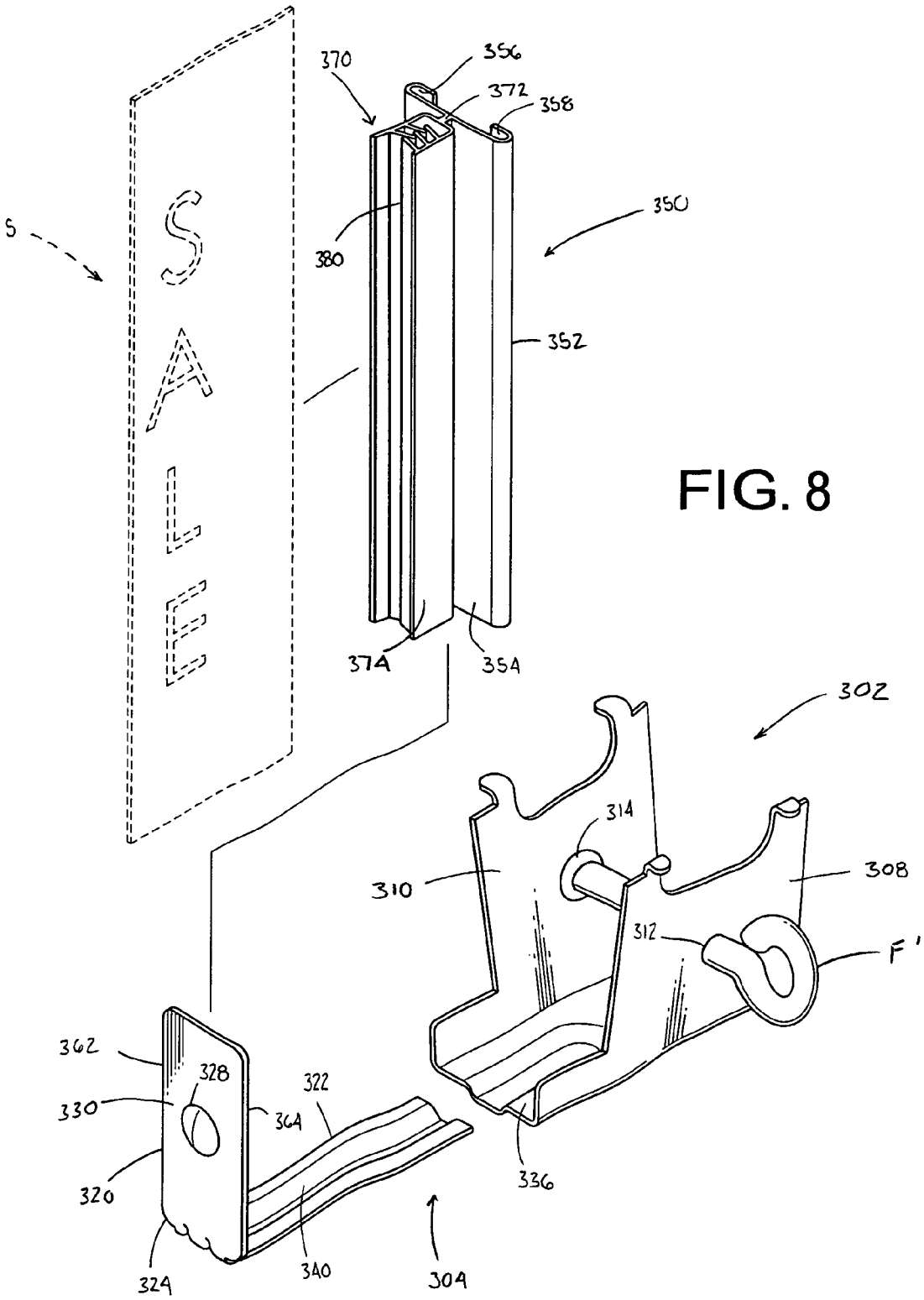
FIG. 8 is an exploded front perspective view illustrating a display system in accordance with a fourth embodiment of the present invention.

With reference to FIGS. 8 and 9, a display system 300 includes a mount 302 and a display member 304. Similar to the previous embodiments, the mount includes first and second opposed arms 308, 310, respectively. Each arm includes an aperture 312, 314, at least one of the apertures can be threaded for receiving a conventional fastener F'. The fastener further secures the mount 302 to a shelf bracket (not shown). The display member 304 comprises a rectangular, generally planar support body 320 and a leg 322 extending away from a lower edge 324 of the support body. The support body includes at least one protrusion 328 extending forwardly of a front, planar surface 330 of the support body. The protrusion can be generally hemispherical in shape, although other shapes are also contemplated. The support body is dimensioned to frictional secure a sign holder 350. The leg can be integrally formed with the support body 320 and can be connected to or integrally formed with a base 336 of the mount 302. The leg includes a strengthening rib 340, which extends partially into the base, to provide the label holder with additional stability against deflecting forces.

The sign holder 350 includes a proximal or engagement portion 352 which is shaped to releasably and frictionally engage the support body 320. Specifically, the engagement portion includes a generally planar forward wall 354 with two opposed rearwardly extending U-shaped flanges 356, 358, which each define a channel to receive opposed sides 362, 364, respectively, of the support body therein.

To assemble the display member 304, the sign holder is positioned above the support body, as shown in FIG. 8, and slid downward over the support body, the flanges slidingly contacting the side of the support body. This operation can be carried out before mounting the mount 302 on the display shelf A', although it can be done afterwards. The sides 362, 364 can have tapered, lower ends adjacent the lower edge 324 of the support body, so that the sides of the support body increase in width towards the bottom, creating an increasing frictional engagement between the flanges and the support body. Additionally, the projection 328 on the front of the support body provides an outward force on the forward wall 354, such that by the time the sign holder has reached the lower edge 324 of the support body 320, the sign holder is gripping the support body sufficiently firmly to resist displacement of the display portion if knocked from below.

The sign holder 350 further includes a display or distal portion, such as a sign holding portion 370, for holding a sign S, which may be a sheet of plastic, card, paper, or the like. The sign displays information about the products on the shelves, such as price. The sign holding portion extends forwardly of the forward wall 354 of the engagement portion 352 and is connected thereto by a hinge 372. The hinge is resiliently flexible, allowing the sign holding portion 370 to flex or pivot in use, relative to the engagement portion, when a force is applied, for example, when a shopper knocks the sign.

The sign holding portion 370 may comprise a U-shaped channel 374 for receiving the sign. Resiliently flexible fins 380 extend into the channel 374 to frictionally engage opposite sides of the sign S. If desired, the fins can be oriented such that their distal tips point rearwardly. The illustrated fins are interdigitated (the tips slightly overlapping), although other arrangements are contemplated. The fins flex rearwardly to allow the sign to be inserted but resist removal of the sign by gripping it when an attempt is made to pull the sign outwardly.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims, or the equivalents thereof.

What is claimed is:

1. A display system for an associated display shelf, comprising:

a generally U-shaped engagement member, including:

a base including first and second side edges and a length, a first arm extending upwardly from said base first side edge and including a distal end, a second arm extending upwardly from said base second side edge and including a distal end, at least one finger extending away from said distal end of each of said first and second arms and including a portion extending in a direction generally perpendicular to a respective plane of said first and second arms, and a respective cutout located in each of said first and second arms, wherein said length of said base is greater than is a length of said first and second arms in the area of said respective cutouts; and, a display member connected to and protruding away from said engagement member, said display member extending from an end edge of said base, the end edge being oriented approximately transverse to said first and second side edges of said base.

2. The display system of claim 1 wherein the respective cutout extends to said respective distal end of said first and second arms.

3. The display system of claim 1 wherein the display member includes a connecting portion and a display portion attached to the connecting portion, the connecting portion being secured to the engagement member.

4. The display system of claim 3 wherein the display portion comprises a hook for receiving associated packages of associated products to be displayed thereon.

5. The display system of claim 3 wherein the display portion comprises a label holder.

6. The display system of claim 3 wherein the display portion comprises a sign holder configured to selectively hold an associated sign in a pivotable manner.

7. The display system of claim 3 wherein the display portion comprises an elongated product holder.

8. The display system of claim 1 wherein the display member is pivotable relative to the engagement member.

9. The display system of claim 1 wherein said engagement member comprises a resilient metallic material.

10. The display system of claim 1 wherein said first and second arms are generally L-shaped.

11. A display system for an associated display shelf, comprising:

a generally U-shaped engagement member, including:

a base including first and second side edges, a first arm extending upwardly from said base first side edge and including a distal end, a second arm extending upwardly from said base second side edge and including a distal end, a pair of spaced generally L-shaped fingers protruding from said distal end of each of said first and second arms said fingers including a portion extending in a direction generally perpendicular to a respective plane of each of said first and second arms, and a generally C-shaped cutout disposed in each of said first and second arms, said generally C-shaped cutout extending inwardly from said distal end between said pair of fingers of each of said first and second arms, wherein said first and second arms are displaceable in relation to each other; and a display member connected to and protruding away from said engagement member, said display member including a connecting portion which is coplanar with said base.

12. The display system of claim 11 wherein said engagement member comprises a resilient metallic material.

13. The display system of claim 11 wherein said display member further comprises a display portion which extends away from a plane of said connecting portion.

14. The display system of claim 11 wherein further comprising a fastener selectively connecting said first and second arms.

15. The display system of claim 11 wherein said first and second arms are generally L-shaped.

16. A display system for an associated display shelf, comprising:

a generally U-shaped engagement member, including:

a base including first and second side edges, a first arm extending upwardly from said base first side edge and including a distal end, a second arm extending upwardly from said base second side edge and including a distal end, at least one generally L-shaped finger protruding from said distal end of each of said first and second arms including a portion which extends in a direction generally perpendicular to a plane of each of said first and second arms, and a first cutout and a second cutout disposed in each of said first and second arms, said first and second cutouts being separated by said finger, and wherein each of said first and second cutouts extend from said distal end of each of said first and second arms;

a display member connected to and protruding away from said base of said engagement member in a plane of said base of said engagement member; and, a fastener extending between and connecting said first and second arms to each other, said fastener being spaced from said base.

17. The display system of claim 16 wherein said engagement member comprises a resilient metallic material.

18. The display system of claim 16 wherein said display member includes:

a connecting portion extending in a plane of said base of said generally U-shaped engagement member, said portion oriented at generally a right angle to said display portion.

19. The display system of claim 18 wherein said display member connecting portion includes a strengthening rib.

20. The display system of claim 16 further comprising:

a first aperture extending through said first arm; and, a second aperture extending through said second arm, said first and second apertures being aligned and allowing said fastener to extend through them.

21. The mount of claim 16 wherein a portion of the display member is secured within a U-shaped channel defined by the base and the first and second arms.

22. The display system of claim 16 wherein said display member includes a display portion which is oriented transverse to both said base and to said first and second arms.

* * * * *